United States Patent [19]

Salomon

[11] 3,930,659

[45] Jan. 6, 1976

[54] SKI BRAKE

[75] Inventor: Georges Pierre Joseph Salomon, Annecy, France

[73] Assignee: S.A. Francois Salomon & Fils, Annecy, France

[22] Filed: June 25, 1974

[21] Appl. No.: 482,883

[30] Foreign Application Priority Data

June 29, 1973 France ..... 73.24091
Apr. 2, 1974 France ..... 74.11638

[52] U.S. Cl. ..... 280/11.13 B
[51] Int. Cl.[2] ..... A63C 7/10
[58] Field of Search...280/11.13 B, 11.13 C, 11.13 D, 280/11.13 Z, 11.37 G, 11.35 C

[56] References Cited

UNITED STATES PATENTS

| | | | |
|---|---|---|---|
| 3,048,418 | 8/1962 | Gertsch | 280/11.13 B |
| 3,249,365 | 5/1966 | Beyl | 280/11.35 T |
| 3,511,516 | 5/1970 | Smolka et al. | 280/11.35 C |
| 3,715,126 | 2/1973 | Schwarz | 280/11.13 B |
| 3,741,575 | 6/1973 | Bortoli | 280/11.13 B |

*Primary Examiner*—Leo Friaglia
*Assistant Examiner*—Milton L. Smith
*Attorney, Agent, or Firm*—Robert E. Burns; Emmanuel J. Lobato; Bruce L. Adams

[57] ABSTRACT

A ski brake for bringing a lost ski on a ski slope to a halt, comprises arms which pivot under spring action into an operative position in which a pointed front end of each arm digs into the snow when the ski boot leaves its bindings. Insertion of the ski boot in the binding causes a pedal to be depressed onto the ski and the pedal moves the arms back into an inoperative position almost parallel to the ski. The rear end of each arm is hollow and contains a spring-loaded piston which bears on a cam. In one embodiment the cam is fixed relative to the ski, and the piston and the arm pivot around the cam surface under the action of the spring when the pedal is released. In another embodiment the cam is part of the arm and forms a pivot mounted to rotate in a bearing in a part of the ski. The cam is pivotted by the spring-loaded piston which in this embodiment is slidably mounted in a sleeve fixed relative to the ski.

14 Claims, 9 Drawing Figures

FIG.6
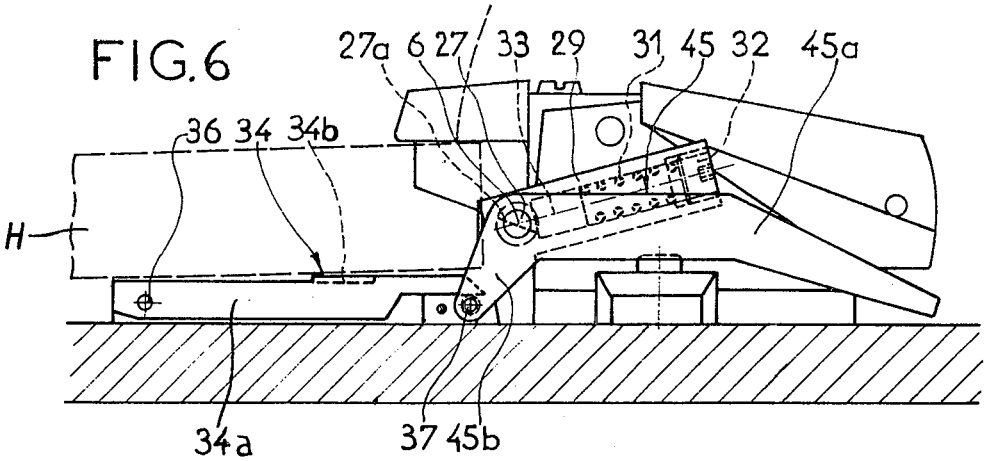
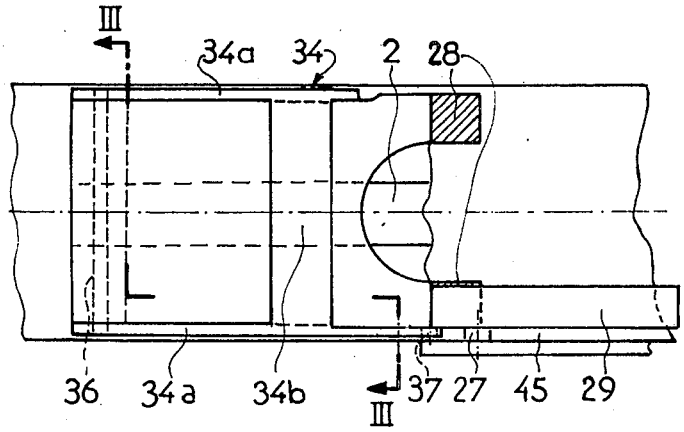
FIG.7
FIG.8
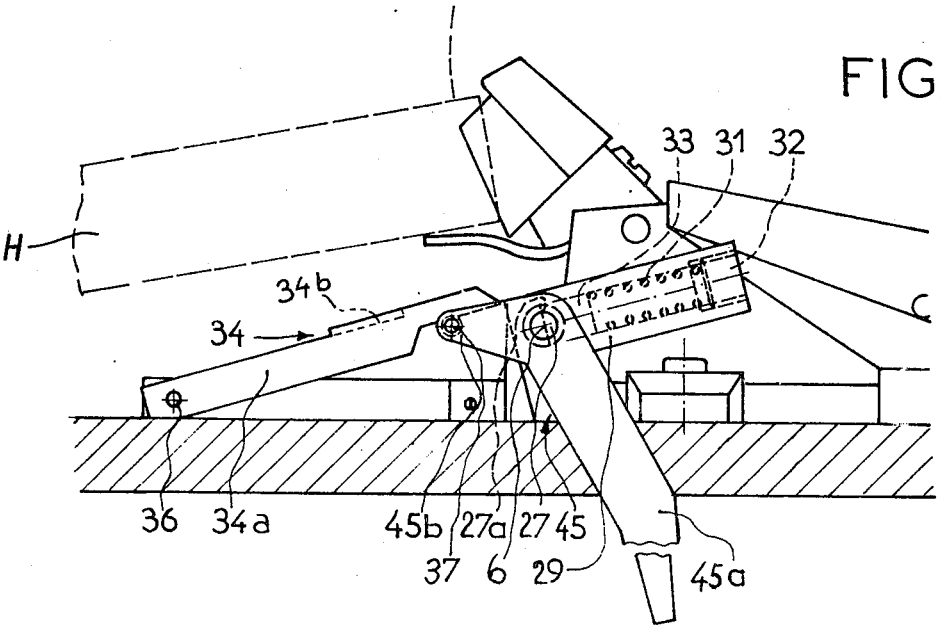

SKI BRAKE

BACKGROUND OF THE INVENTION

The present invention concerns a ski brake, i.e., a device intended to prevent a ski from sliding down a slope if, a safety binding having become undone in the course of a descent, the ski is no longer attached to the skier. A device of this kind therefore replaces the safety bindings at present in use.

Such a device generally comprises a kind of "spike" or sideways brake arms which by means of spring pressure project downwards from the base of the ski as soon as the binding loosens and the ski boot is removed therefrom. The spike or brake arms thereupon more or less penetrate the snow, the ski comes to a halt on the slope and the skier can easily recover it. There is therefore no risk of the ski descending the slope and either injuring skiers further down or of becoming lost.

In known devices of this kind, their action is basically dependent on a torsion spring coiled round the transverse fixed shaft round which the spike or brake arm rotates. This arrangement is not particularly advantageous since the spring is fully extended when it forces the arm to project from the base of the ski: as a result the spring can offer only very feeble resistance to a displacement of the arm which can be easily pushed back by obstacles it comes up against before the ski stops. It is therefore obvious that if the arm retracts when it encounters obstacles the braking effect is not as efficient as it could be.

Moreover, once the boot is removed the brake arm or arms situated at the side of the ski project permanently from the underside of the ski, which makes transport of the ski awkward. To remedy this inconvenience, a bolt arrangement has been devised which immobilizes the arm or arms on the ski during transport. This solution is not ideal, however, since while it eliminates one inconvenience it introduces another, this being the risk of forgetting to undo the bolt when ski-ing commences. Once the boot is freed owing to a fall, the blocked brake cannot therefore function and the ski will set off by itself down the slope. Further, as this bolt is situated below the boot, it is not subject to visual control.

The general object of the present invention is to remedy these inconveniences by proposing a ski brake comprising an activating system of such construction that the spring is not completely extended in its operative position, i.e., when the brake arm or arms project from the base or underside of the ski.

SUMMARY OF THE INVENTION

According to the invention there is provided a ski brake withdrawable and rendered inoperative when a ski boot is placed in position on the ski, comprising: at least one brake arm forming a spike fitted laterally to the ski and pivoting relative to the ski about a generally transverse axis, said arm being activated by resilient means towards an operative braking position in which it projects beneath the base of the ski, a pedal extending above the upper surface of the ski which is pushed onto this surface by the ski boot, thereby retracting the arm into a first inoperative position in relation to the ski, a sleeve in which said resilient means is lodged with one end thereof supported by one end of the sleeve, piston means slidably located in said sleeve, and a cam located in said sleeve at its other end, said piston means being permanently thrust against said cam by said resilient means, said cam being operative about said transverse axis of said brake arm and having a profile such that the pressure exerted by said piston means on the cam by the action of said resilient means functions through a couple acting on said brake arm and causing said brake arm to pivot into said operative braking position when said ski boot leaves said pedal.

According to one embodiment of the invention, the cam is fixed and thus itself forms a journal about which the brake arm pivots, the latter being hollow and itself forming the sleeve in which the piston is lodged, thrust against the fixed cam.

According to a modified embodiment, the cam is integral with the brake arm and forms a pivot set to rotate in a bearing, the cam being subject to the action of a piston thrust back by a spring, these being lodged in a fixed sleeve.

In both embodiments of the invention, the cam, whether it forms a journal or a pivot, is preferably constituted by a generally semi-cylindrical member offering a smooth diametrical support surface or forming a dihedral. This support surface slopes in relation to the base of the ski in such a way that when the brake arm is both in the first rest position and in the operative position the resilient means is under tension and that in said rest position the resilient means is forcibly stretched, exerting a return pressure on the arm causing it to return automatically to the operative position.

In the event of the cam forming a fixed journal, the operative position of the arm is that where its axis is at right angles to the smooth supporting surface of the cam and is aligned with the bisector of the dihedral formed by this cam. The fixed cam may comprise a second, auxiliary support surface which would serve to keep the arm retracted during transport and arranged in such a way that the brake pedal remains slightly raised in front of the ski boot fastening abutment, without however the operating end of the pivoting arm extending beyond the base of the ski. In this way the brake prevents the binding from catching during transport.

BRIEF DESCRIPTION OF THE DRAWINGS

Embodiments of the present invention will now be described by way of example only, with reference to the appended drawings, in which:

FIG. 6 is an elevation of an alternative form of the ski brake in which the cam is integral with the brake arm and forms a pivot fitted so as to rotate, the brake arm being represented in its rest position;

FIG. 7 is a partial plan-view of the ski brake of FIG. 6, the fastening being assumed to be removed; and FIG. 8 is an elevation similar to that of FIG. 6, the brake arm being represented in operative position.

DESCRIPTION OF PREFERRED EMBODIMENTS

Figure 1:
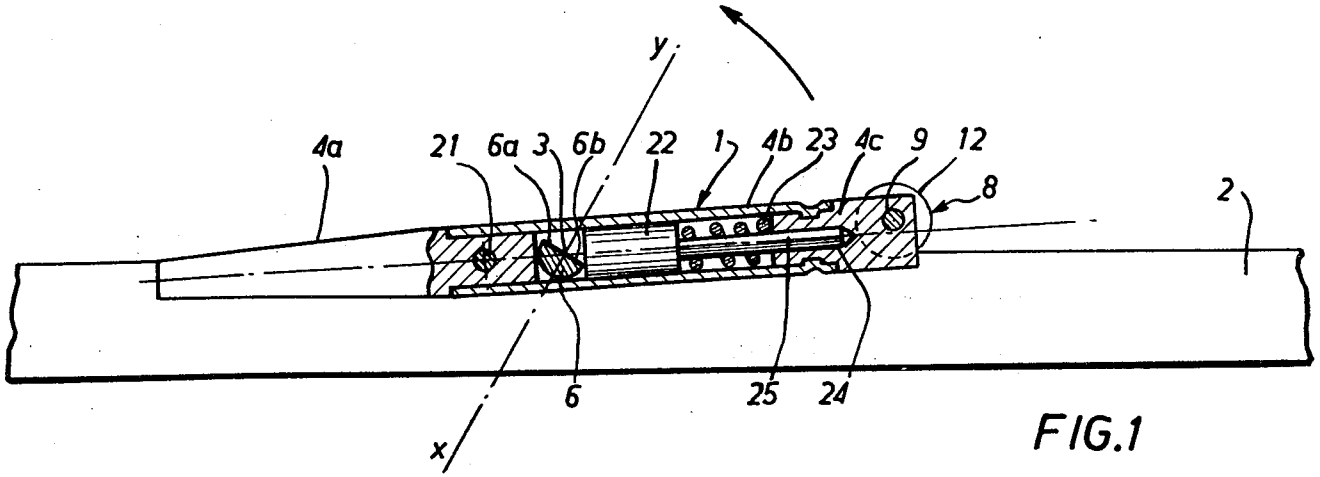
FIG. 1 is a longitudinal and vertical sectional view of a ski brake according to the invention, in a first rest position, the section being taken along line I—I in FIG. 2.

A ski brake 1 according to the invention is fitted to pivot on a ski 2 about a horizontal transverse axis 3 located broadly on the plane of the upper face of the ski 2.

In the embodiment shown in FIGS. 1 to 4 of the drawing, the ski brake comprises two brake arms 4 and 5 adjoining the vertical side faces of the ski and articulated about fixed cams, 6 and 7 respectively, having the same axis 3 and forming journals for the arms.

The arms 4 and 5 respectively comprise solid forward parts 4*a* and 5*a*, preferably tapering towards the front, in such a way as to form spikes or points engaging with the snow when the ski brake is operative. The also comprise hollow rear parts, 4*b* and 5*b* respectively, which are interconnected at their ends by a pedal 8 which extends crosswise. This pedal comprises two transverse shafts 9 and 10 pointing towards each other and riveted to the respective parts 4*b* and 5*b* of the arms, an intermediate shaft 11, and two rollers or sleeves, 12 and 13, fixed respectively on and by the shafts 9 and 10. The intermediate shaft 11 is axially fixed to and in the roller 12 and runs freely in the other roller 13 in such a way as to form a sliding fitting to allow the pedal 8 to be adapted to the breadth of the ski.

Furthermore, as may be seen from the drawing, the peripheral face of the rollers 12 and 13 of the pedal 8 projects slightly beyond the profiles of the arms 4 and 5 in such a way that the base of the ski boot bears solely on the rollers and so that friction against the base is minimal.

The cams 6 and 7 of the brake are borne by vertical wing angle members 14 and 15 of plates 16 and 17 that are adjustable sideways and pierced by holes, 18 and 19 respectively, for the passage of fastening bolts on the ski.

The mechanism allowing the ski brake to operate will now be described, with reference solely to arm 4, the other arm 5 containing a similar mechanism.

Arm 4 is, as we have seen, formed by the solid forward part 4*a* and the rearward part 4*b* which is hollow and forms a sleeve, these two parts being interconnected by a rivet 21. The rearward part 4*b* is crossed by the cam 6, forming a journal, and contains a flat piston 22 fitted in sliding fashion. A compression spring 23 is also lodged in the rearward part 4*b* and this spring is supported, at the one end, by the piston 22 and, at the other end, by the front face of an end plug 4*c* set on the sleeve of the rearward part 4*b*, on which plug the shaft 9 is riveted. The plug 4*c* is pierced by a reamed hole 24 in which a stem 25 of the piston 22 engages.

The cam 6 has a support surface or slope 6*a* for the piston 22, which piston is permanently thrust against the cam by the action of the spring 23. In the embodiment shown in FIGS. 1 to 4 this support surface 6*a* is flat and diametrical and slopes downwards and backwards at an angle of about 30° in relation to the upper face of the ski 2. The cam 6 therefore has the form of a cylinder with a semi-circular section.

When the ski brake is in the first rest position (FIG. 1) the sole of the ski boot maintains the unit virtually horizontal by resting on the pedal 8. In these circumstances the forward parts 4*a* and 5*a* of the arms 4 and 5 are withdrawn upwards and are more or less on a level with the upper face of the ski. The piston 22 is in contact with the lower edge 6*b* of the semi-cylindrical cam 6 and, consequently, is pushed in the direction of the plug 4*c*, thus relatively forcibly depressing the withdrawal spring 23.

Should the boot leave the ski, as a result of the binding coming undone, the ski brake is thereby freed; that is, as the spring 23 due to its being compressed exerts a force on the arm causing it to pivot about edge 6*b* of cam 6 in anti-clockwise direction in relation to FIG. 1, the whole unit forming the brake pivots into its operative position, in which the piston 22 is fully up against the support surface 6*a*. In this position the axis of the arms 4 and 5 coincides with line *xy* which is at right angles to the support surface 6*a*. In this position (FIG. 3) the spring 23 continues to be sufficiently compressed for the brake to be firmly maintained in operative position and cannot therefore be deflected by any possible obstacles. In this way quick and efficacious immobilization of the errant ski is ensured.

As may be seen in the foregoing description, the whole of the operating mechanism is lodged within each of the arms and consequently protected against dust, dirt, humidity and, consequently, seizure and frost.

Figure 3:
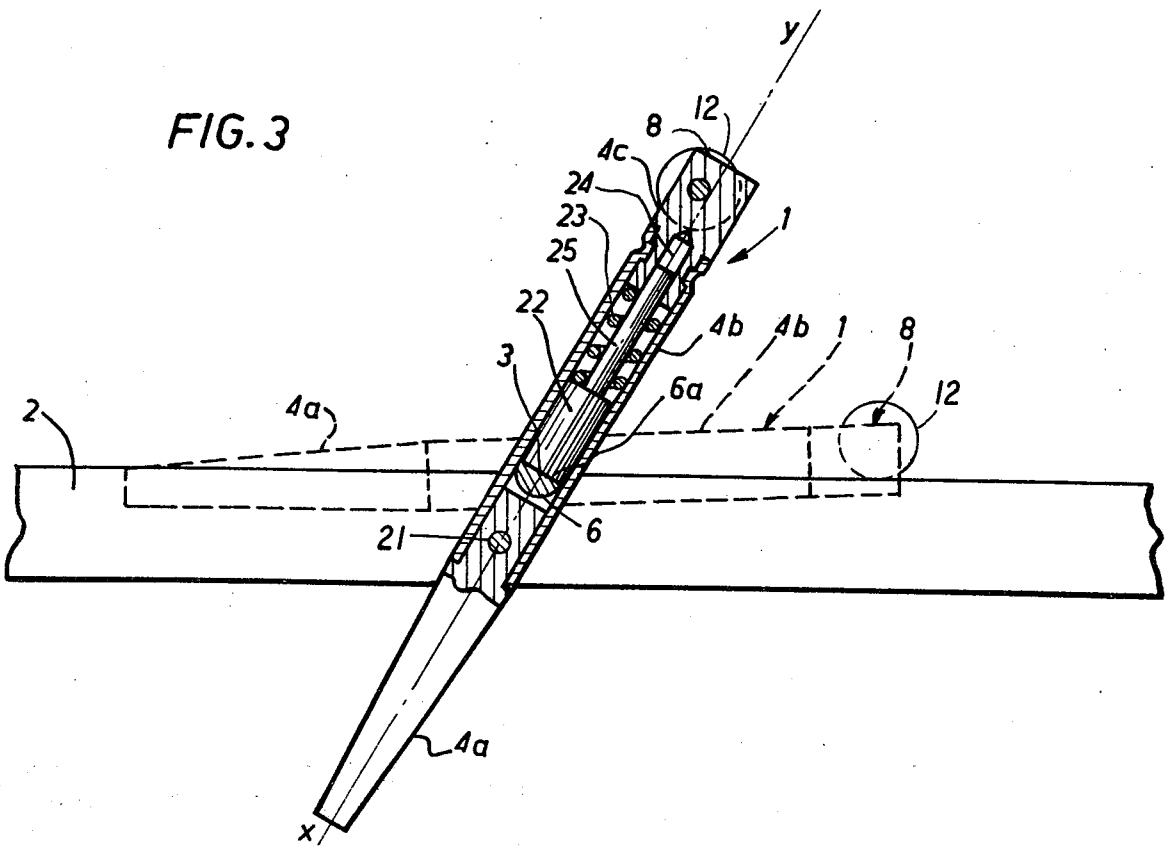
FIG. 3 is a sectional view of the ski brake in operative position.

If, as from the operative position in FIG. 3, the brake 1 is further pivoted in anti-clockwise direction the piston 22 comes into contact with the semi-circular surface 6*c* of the cam 6 after rotating through at least 90° from the operative position, and at this point elastic return ceases. The second rest position, achieved thereby, is sufficiently stable for transport: neutral equilibrium is then obtained.

Figure 4:
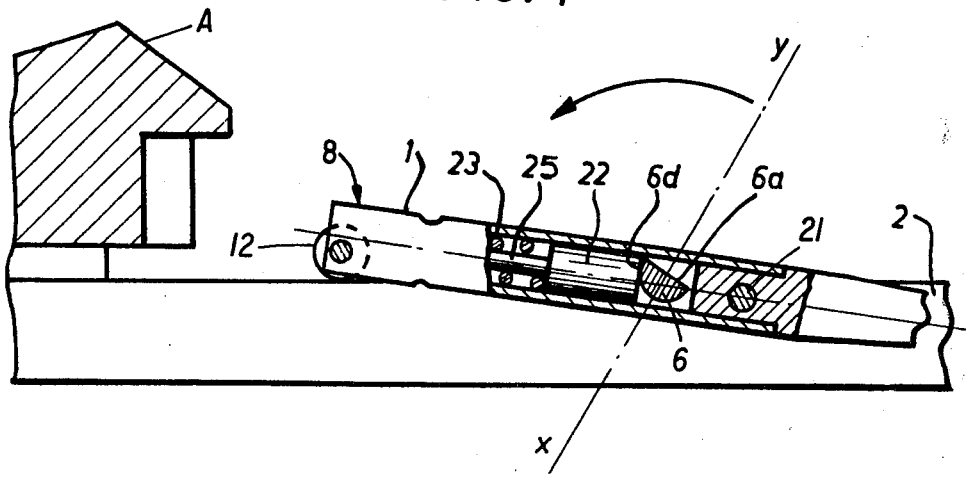
FIG. 4 is a diagrammatic sectional view of the ski brake in a second rest position or during transport.

So as to have only one set transporting position the pivot may be equipped with a second support surface or auxiliary slope 6*d*, as shown in FIG. 4. This slope 6*d* is located in relation to the first slope 6*a* in such a way that when in corresponding rest or transport position the activating mechanism keeps the pedal end of the brake slightly raised above the ski, before the abutment A, without the arms, however, extending beyond the base of the ski. In this way the brake pedal 8 placed in front of the abutment prevents any catching when the brake is not in set position. When the skier wishes to attach the ski as from the position in FIG. 3 he puts the front of his boot on the abutment shown in FIG. 4 and lowers his heel. The sole rolls on the rollers of the pedal 8 and the brake returns to the position in FIG. 1. At the same time, the heel acts on the pedal of the heel section (not shown) and the whole unit is re-set without manual intervention.

Figure 5:
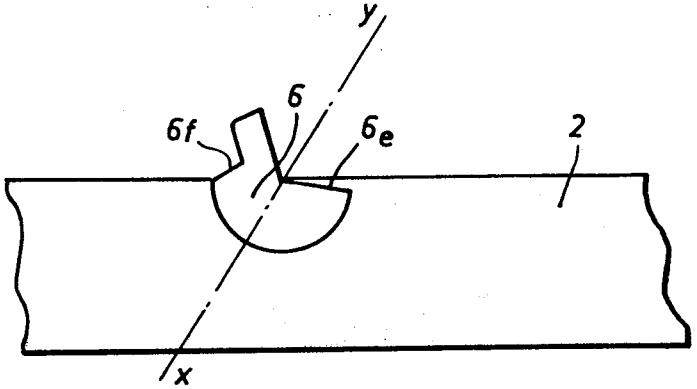
FIG. 5 is a view of an alternative form of a fixed cam forming a journal for the stopping arm

FIG. 5 shows an alternative form of the cam 6 of the arm 4. In this case the flat diametrical slope 6*a* has been replaced by a V-shaped or dihedral slope 6*e*, whose bisector *xy* extends backwards and upwards at an angle of about 60°. In the same way, the slope 6*f* determining the rest or transport position is equally profiled in V-shape with this always being less deep than that of the slope 6*e*. In this case the piston is also dihedral in shape.

According to a variation, the ski brake may comprise only one single pivoting arm 4 or 5, to which the pedal 8 is attached at its upper moving end.

Moreover, the piston 22 may comprise a ball or any other intermediate device enabling the pressure exerted by the spring 23 to be applied to the support surface.

Figure 5A:
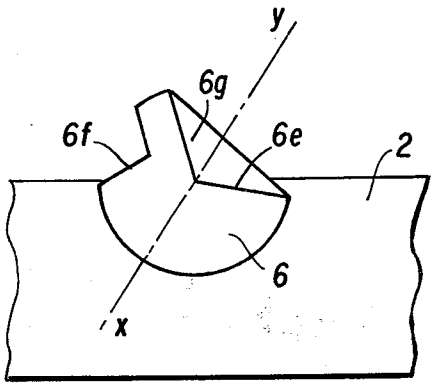
FIG. 5A is a view of an additionally modified cam.
Figure 2:
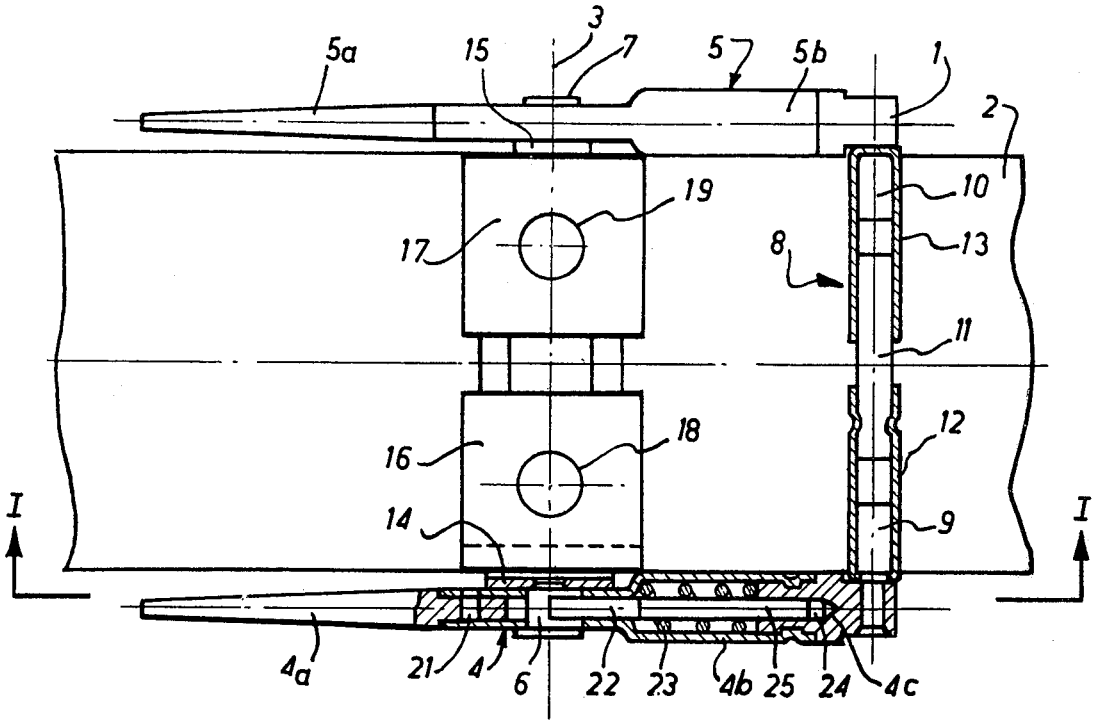
FIG. 2 is a plan-view partly in horizontal section of the ski brake shown in FIG. 1.

The support surface 6*e*(FIG 5*a*) may also be part of a cone 6*g* whose axis *xy* slopes upwards and backwards and which is penetrated by a ball thrust forward by the spring 23.

Provision may be made for the pressure of the spring 23, and consequently the return force on the brake in operative position, to be regulated. The spring 23 may be of any known type such as, in particular, a spiral or flat zigzag spring. Such spring could be lodged in one only of the two arms 4 or 5.

A second embodiment of the ski brake in accordance with the invention will now be described in relation to FIGS. 6–8.

As in the first embodiment described above this brake comprises one or two arms 45 arranged laterally and pivoting about a transverse axis 13. However, each brake arm 45 is in the form of a two-branched lever and includes a rear branch 45*a* forming a spike intended to dig into the snow when the brake is in operative position, and a forward branch 45*b* rather shorter than the branches 45*a*. In the first rest position (FIG. 6) the rear branch 45*a* extends appreciably horizontally rearwards while the forward branch 45*b* slopes downwards and forwards.

Each of the arms is integral with a cam 27 forming a pivot set to rotate in a bearing fitted in a vertical column 28 forming part of the ski. This column is extended upwards and backwards by a sleeve 29 within which a coiled compression spring 31 lodges, if necessary supported at its external end by a calibrating plug 32 screwed into the tapped end of the sleeve 29. The spring 31 also rests, at the internal end, on a piston 33 or any other similar device (ball, etc.).

The bearing, within which the cam forming the pivot 27 swivels, opens into the internal chamber of the sleeve 29; at this point the cam 27 offers a diametrical supporting surface 27*a* against which the piston 33 is pressed by the action of the spring 31.

The ski brake moreover includes a resetting pedal 34 hinged at its front end on the ski about a transverse axis 36. The pedal 34 essentially comprises two vertical side branches 34*a*, articulated about the axis 36 at their forward ends, and connected at their rear ends by a transverse bar 34*b* on which the heel H of the ski boot rests. The branches 34*a* are extended backwards and their rear end parts lie above transverse lugs 37 extending toward the longitudinal axis and borne by the forward branches 45*b* of arms 45. In this way the pedal 34 at all times rests on these lugs 37 and acts on the arms 45.

When the safety binding is loosened and the ski separates from the boot the ski brake pivots from its rest position shown in FIG. 6 to the operative position shown in FIG. 8. In fact, when the heel of the boot leaves the resetting pedal 34 the spring 31, which pushes the piston 33 forward, causes the pivoting cam 27 to turn clockwise until the piston 33 comes to rest against the diametrical face 27*a* (FIG. 8). The result is a concomittant pivoting movement of the arm 45, and its rear branch 45*a* thereupon projects below the base of the ski and can then dig into the snow.

When the skier resets his ski the action of the heel of his boot on the pedal 34 provokes an inverse movement of the arm 45 which returns to its withdrawn rest position (FIG. 6).

I claim:

1. A ski brake withdrawable by placing a ski boot in position on a ski, comprising:

at least one brake arm providing a spike fitted laterally to a ski and pivoting relative to the ski about a generally transverse axis;

resilient means for moving said arm towards an operative braking position in which it projects beneath the base of the ski;

a pedal mounted on the brake arm, extending above the upper surface of the ski and disposed to be pushed onto this surface by a ski boot placed in position on the ski, thereby retracting the arm into an inoperative rest position in relation to the ski;

a sleeve in which said resilient means is lodged with one end thereof supported by one end of the sleeve;

piston means slidably located in said sleeve; and a cam located in said sleeve at its other end;

said piston means being permanently thrust against said cam by said resilient means, and said cam being disposed about said transverse axis of said brake arm and having a profile such that the pressure exerted by said piston means on the cam by the action of said resilient means functions through a couple acting on said brake arm and causing said brake arm to pivot into said operative braking position when said ski boot leaves said pedal.

2. A ski brake as claimed in claim 1, wherein said resilient means is a coiled compression spring.

3. A ski brake as claimed in claim 1, wherein said cam is fixed and thus constitutes a journal for the pivoting of said brake arm, said brake arm having a hollow portion constituting the sleeve in which said piston means is thrust against said fixed cam.

4. A ski brake as claimed in claim 3, wherein said cam has a support surface against which said piston means is thrust, said support surface sloping downwardly and backwardly in relation to the base of said ski.

5. A ski brake as claimed in claim 4, wherein said support surface is flat and diametrical and wherein said cam is semi-circular.

6. A ski brake as claimed in claim 4, wherein said support surface of the cam has an angular shape whose bisector slopes upwards and backwards, the remainder of the cam surface having a circular section.

7. A ski brake as claimed in claim 6 wherein said angular shape is the shape of a dihedral.

8. A ski brake as claimed in claim 6 wherein said angular shape is the shape of a cone.

9. A ski brake as claimed in claim 4, wherein said cam has means, defining a second, auxiliary, support surface, for keeping the arm withdrawn during transport and arranged in such a way that said pedal in the rest position of the arm is slightly raised in front of a ski boot fastening abutment for the ski.

10. A ski brake as claimed in claim 1, including a second pivoting brake arm constructed and disposed similarly to said one arm, the two arms respectively adjoining two vertical side faces of said ski and each being articulated about a respective cam, said cams providing journals on said transverse axis, said two arms each having a rearward part, said rearward parts being connected together at their rear ends by said pedal extending transversely to said ski and said arms, at least one of said arms containing said resilient means in its said rearward part.

11. A ski brake as claimed in claim 10, wherein said pedal comprises two mutually telescoping shafts fixed respectively at the ends of said rearward parts of the arms and aligned transversely of the ski, two mutually facing aligned roller sleeves mounted so as to rotate on respective ones of said shafts, and an intermediate shaft engaged in said roller sleeves.

12. A ski brake as claimed in claim 1, wherein said cam is integral with said brake arm and constitutes a pivot mounted to rotate when said cam is subjected to the thrust of said piston means actuated by said resilient means, said sleeve containing the resilient means and piston means being disposed to be fixed to the ski.

13. A ski brake as claimed in claim 12, wherein said cam has a diametrical support surface towards which said piston means is thrust by said resilient means.

14. A ski brake as claimed in claim 1, including means for enabling the pedal to be disposed in a second inoperative rest position opposite an abutment for a ski boot, slightly raised above the ski; the pedal comprising at least one transverse shaft and a roller fitted thereon whose peripheral surface projects in relation to the profile of the arm on which the pedal is mounted.

* * * * *